US005685221A

United States Patent [19]

Newman

[11] Patent Number: 5,685,221

[45] Date of Patent: Nov. 11, 1997

[54] FLOOD BAR FOR SCREEN PRINTING

[75] Inventor: Don E. Newman, Wyncote, Pa.

[73] Assignee: Stretch Devices, Inc., Philadelphia, Pa.

[21] Appl. No.: 371,732

[22] Filed: Jan. 12, 1995

[51] Int. Cl.[6] ..... B41F 15/44

[52] U.S. Cl. ..... 101/123; 101/124

[58] Field of Search ..... 101/114, 120, 101/123, 124, 169; 118/413; 15/256.5

[56] References Cited

U.S. PATENT DOCUMENTS

| | | | |
|---|---|---|---|
| 3,735,730 | 5/1973 | Mitter | 101/120 |
| 3,788,219 | 1/1974 | Gallagher | 101/425 |
| 3,822,642 | 7/1974 | Grindeland | 101/425 |
| 3,960,076 | 6/1976 | Wick | 101/119 |
| 3,998,157 | 12/1976 | Mitter | 101/120 |
| 4,036,129 | 7/1977 | Zimmer | 101/120 |
| 4,069,756 | 1/1978 | Vertegaal | 101/120 |
| 4,078,486 | 3/1978 | Moser | 101/123 |
| 4,083,633 | 4/1978 | Shanly | 355/15 |
| 4,107,812 | 8/1978 | Lantto | 15/245 |
| 4,254,709 | 3/1981 | Arnolds | 101/425 |
| 4,299,164 | 11/1981 | Jonkers | 101/120 |
| 4,409,700 | 10/1983 | Sullivan | 15/121 |
| 4,586,212 | 5/1986 | Gasser | 15/256.51 |
| 4,716,616 | 1/1988 | Poon | 15/245 |
| 4,742,595 | 5/1988 | Isaacs | 15/105 |
| 4,841,854 | 6/1989 | Bubley | 101/123 |
| 5,027,703 | 7/1991 | Hancy | 101/123 |
| 5,078,061 | 1/1992 | Messerschmitt | 101/123 |
| 5,099,783 | 3/1992 | Bourgeois | 101/123 |

FOREIGN PATENT DOCUMENTS

| | | | |
|---|---|---|---|
| 341846 | 11/1992 | Japan | 101/123 |
| 8301313 | 11/1984 | Netherlands . | |
| 1 215 200 | 12/1970 | United Kingdom . | |

*Primary Examiner*—Stephen R. Funk
*Attorney, Agent, or Firm*—Seidel Gonda Lavorgna & Monaco, PC

[57] ABSTRACT

An apparatus spreads and positions ink into orifices of a screen fabric for printing. The apparatus has a flooding portion having an ink interaction surface spaced and overlying the screen. The ink interaction surface is adapted for interacting with the ink to force the ink into the orifices of the screen fabric. Several of the embodiments of the apparatus have a bottom surface generally parallel to the screen, wherein the bottom surface has sufficient width for forcing the ink into the orifices of the screen fabric. In addition, the ink interaction surface in several of the embodiments has at least one concave curved portion adapted for rotating the ink. In some embodiments, the ink interaction surface has a pair of concave curved portions wherein one of the concave curved portions has a larger radius than the other concave curved portion.

33 Claims, 9 Drawing Sheets

FIG. 4
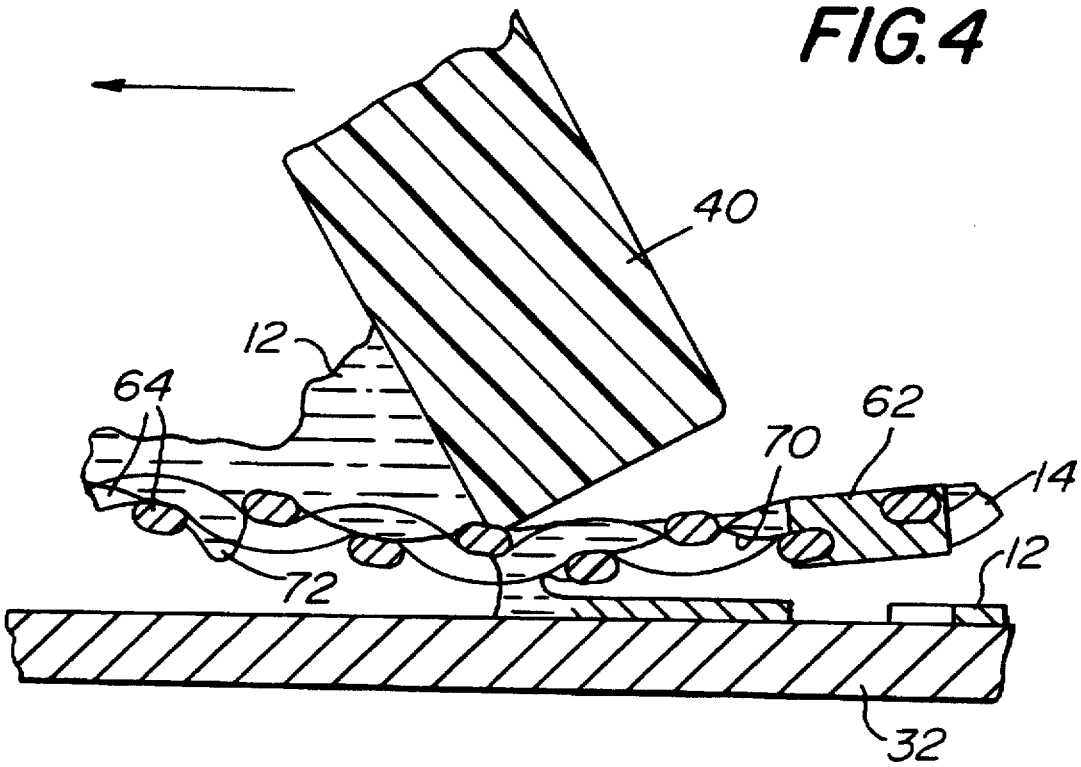
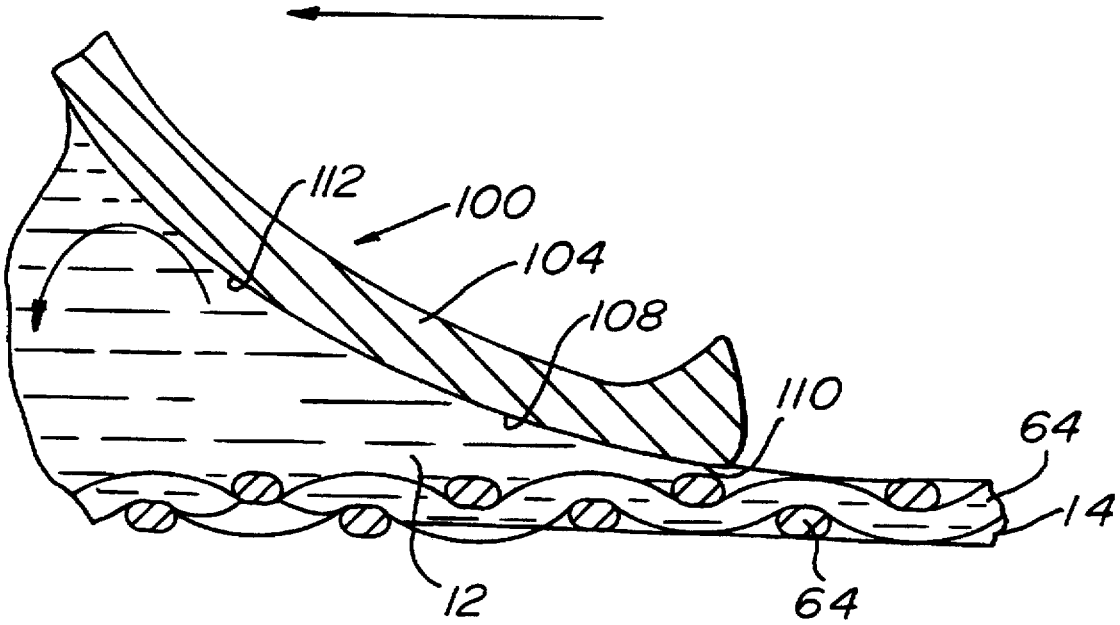
FIG. 8A

FIG.10
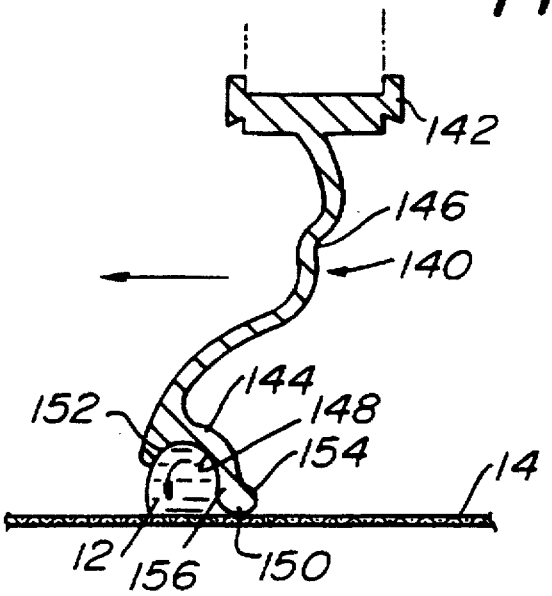
FIG.11
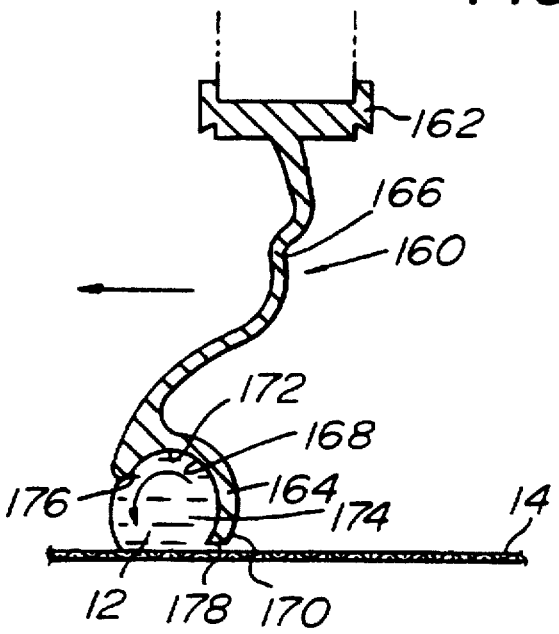
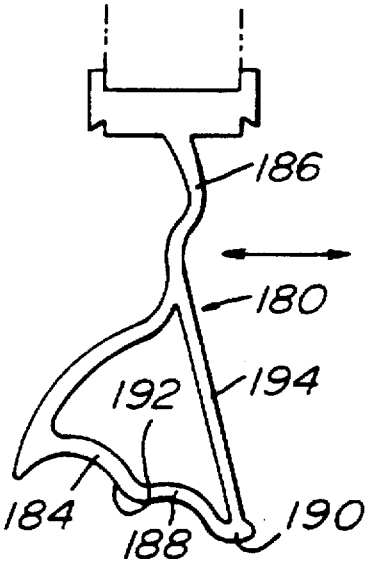
FIG.13

FLOOD BAR FOR SCREEN PRINTING

FIELD OF THE INVENTION

This invention relates, generally, to a method and apparatus for placing ink over and/or into openings ("orifices") in a screen fabric for screen printing. More particularly, the invention relates to a flood bar and method of using the flood bar for quickly and uniformly positioning ink into the openings in the screen fabric.

BACKGROUND OF THE INVENTION

There are four major styles of printing: relief, intaglio, planographic, and porous printing. Porous or screen printing has lagged in development but has increased rapidly in recent years. Screen printing was initiated with an image located on a screen and in contact with a substrate with the ink or dye pushed or dragged through the screen.

The technology evolved into raising the screen fabric above the substrate. The distance between the screen fabric and the substrate is defined as an off contact distance. A squeegee used to push the ink from the screen fabric onto the substrate, deflects the screen to touch the substrate. The force on the screen fabric due to tension and deflection causes the screen fabric to snap away from the substrate as the squeegee moves. In recent years, the tension placed on the screen has increased from a range of seven newtons per centimeter to that of eighty-five newtons per centimeter and higher. The development of higher screen tensions has resulted in the screen being able to be placed in closer proximity to the substrate, thereby virtually eliminating image distortion, reducing interface friction between the screen fabric and the squeegee or flood bar, and achieving more uniform interface pressure as well as other benefits. The higher tension in the screen reduces the amount of deflection experienced by the screen fabric. The higher tension and reduced off contact distance results in a higher quality and faster operation. The higher screen tension is just one of several factors that influence achieving the best result most economically.

Another factor that has been recognized as affecting speed and quality is the process of placing a layer of ink on the screen fabric for the squeegee to transfer from that position to the substrate. However, until this invention, the extent to which this process could control the overall speed and quality of printing was not fully realized. The process of flooding the screen consists of initially placing a line of ink along one side of the screen. An apparatus, typically a flood bar, pushes the line of ink from one end of the screen fabric to the other end of the screen fabric, thereby coating or flooding the entire top surface of the screen or partially filling the orifices of the screen fabric with ink. The amount of ink that the orifices receive is dependent on the viscosity of the ink, on the theological characteristics of the ink, and on other factors.

After the entire top of the screen is covered with ink, the squeegee deflects the screen fabric, as described above, such that the bottom of the screen fabric comes in contact with the substrate. The squeegee forces the ink first into the orifices of the screen fabric. Then, once the ink is at the bottom of the orifices, the ink can adhere to the substrate. As the squeegee moves forward, the screen fabric snaps up and the ink is extracted in the proper location on the substrate.

While the increase in screen tension, the improved screen material, and the improved quality of inks have resulted in faster screen printing with improved quality, there is always a desire to increase production while maintaining quality and, if possible, increasing quality. It is therefore desired to improve the capability of the flood bar to achieve faster speed and better print quality.

SUMMARY OF THE INVENTION

The present invention provides an apparatus for spreading and positioning ink into the orifices of a screen fabric for printing. The apparatus has a flooding portion having an ink interaction surface spaced and overlying the screen fabric. The ink interaction surface is adapted for interacting with the ink to force the ink into the orifices of the screen fabric.

In several of the embodiments, the flooding portion has a bottom surface generally parallel to the screen fabric. The bottom surface has a sufficient width for forcing the ink into the orifices of the screen fabric.

The ink interaction surface in several of the embodiments has at least one concave curved portion adapted for rotating the ink. In one of the preferred embodiments, the ink interaction surface has a pair of concave curved portions, one of the concave curved portions having a larger radius than the other concave curved portion. The larger radius curved portion feeds the smaller radius curved portion.

One object, feature, and advantage of the invention resides in the ink interaction surface creating a rotation of the ink as the apparatus, a flood bar, moves across the screen forcing the ink into the orifices of the screen.

Another object, feature, and advantage of the invention resides in the increased surface interacting with the ink. The increased surface gives more hydraulic force and provides more time to force the ink into the orifices. This allows the flood bar to move faster across the screen and still achieve better filling of the orifices.

Yet another object, feature, and advantage of the invention resides in the rotation of the ink created by the interaction of the ink interaction surface and results in containing the ink and preventing it from moving perpendicular to the movement of the flood bar.

A further object, feature, and advantage of the invention resides in the increased surface interacting with the ink. Any irregularities such as nicks on the flooding portion of the flood bar will have a minimal effect on the influence of getting ink into the orifices of the screen fabric, as contrasted to the narrow edge of the prior art.

Further objects, features, and advantages of the present invention will become apparent to those skilled in the art as the nature of the invention is better understood from the accompanying drawings and detailed description.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 4 is an enlarged cross-sectional view of a screen fabric with a prior art squeegee;

FIG. 8A is an enlarged cross-sectional view of the second embodiment flood bar interacting with the screen fabric and the ink;

FIG. 10 is a cross-sectional view of a fourth embodiment of a flood bar interacting with the screen fabric and ink;

FIG. 11 is a cross-sectional view of a fifth embodiment of a flood bar interacting with the screen fabric and ink;

FIG. 13 is a side view of a sixth embodiment of a flood bar; and

DETAILED DESCRIPTION OF THE DRAWINGS

Figure 1:
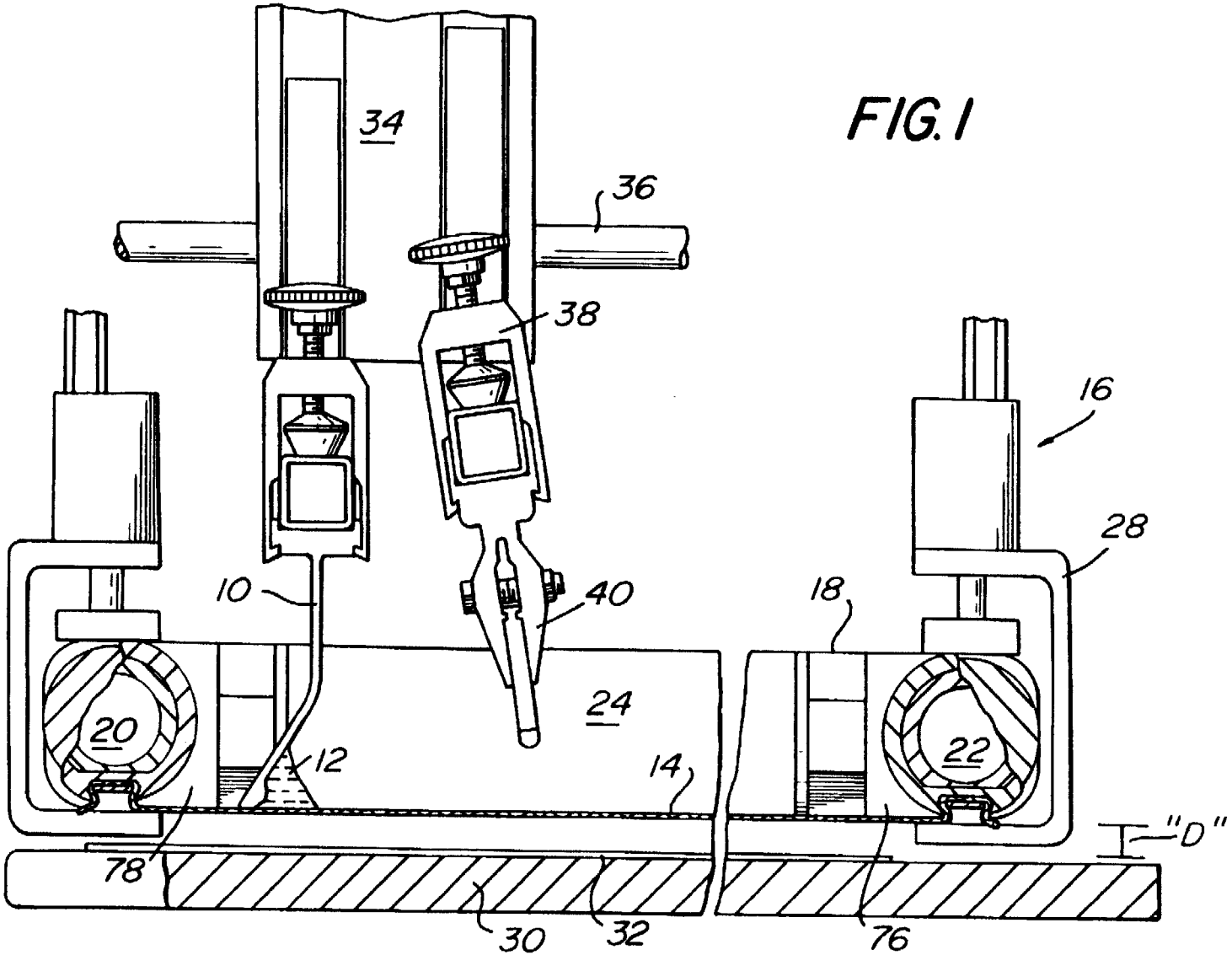
FIG. 1 is a broken out side view of an automatic screen printing machine having a flood bar for placing ink in a screen fabric in accordance with the present invention.

Referring to the drawings, where like elements are identified by like numerals, there is shown in FIG. 1 an embodiment of a flood bar 10 for loading ink 12 into a screen fabric 14.

Referring to FIG. 1, a printing machine 16 has a tensioning frame 18 having four rollers, only three shown, 20, 22, and 24, for holding the screen fabric 14 in tension. U.S. Pat. Nos. 3,908,293 and 4,345,390 disclose such a tensioning frame device and are incorporated herein by reference. The tensioning frame 18 and screen fabric 14 are held in the printing machine 16 by a pair of clamps 28.

The printing machine 16 has a platform 30 on which lies a substrate 32 that is to receive the ink 12. The screen fabric 14 in the tensioning frame 18 is held by the clamps 28 a certain distance above the substrate 32, such as a shirt or poster, that is to receive the ink 12. This distance is defined as an off contact distance "D." Substrates for screen printing also include automotive parts, glass, bottles, and gaskets.

Figure 6:
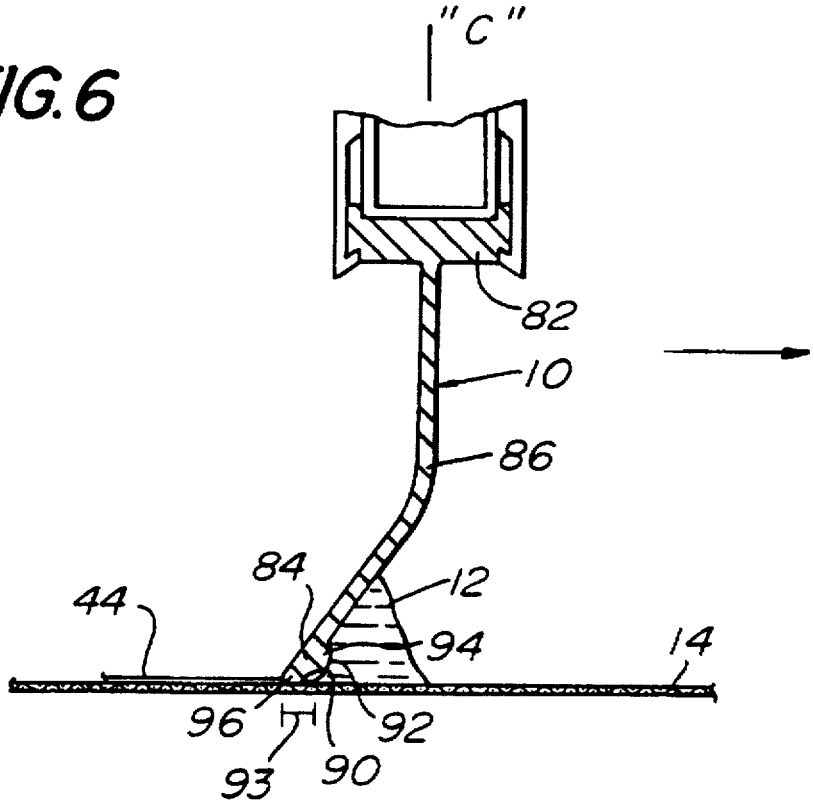
FIG. 6 is a cross-sectional view of a flood bar of the first embodiment interacting with the screen fabric and ink.

The printing machine 16 has a head 34 which moves translationally along a pair of rails 36, only one shown, in a direction usually parallel to the screen fabric 14 and perpendicular to two of the rollers 20 and 22. The head 34 has a pair of mounting apparatus 38 for receiving the flood bar 10 and a squeegee 40, respectively. Each mounting apparatus 38 has a pair of cylinders, not shown, which move the mounting apparatus 38 between a lowered operational position and a raised position. The flood bar 10 is shown in the lowered operational position and the squeegee 40 is shown in the raised position. As the head 34 moves translationally in one direction, to the right as shown in FIG. 1, the flood bar 10, which is lowered, places a flood coat layer 44 of the ink 12 over the screen fabric 14, as shown in FIG. 6. On the return stroke, the flood bar is moved to the raised position and the squeegee 40 is lowered into contact with the screen fabric 14 and deflects the screen fabric 14 thereby depositing the ink 12 on the substrate 32. Each of the mounting apparatus 38 has a limited pivotable adjustment means, not shown, for allowing adjustment of the angle of the flood bar 10 or squeegee 40 relative to the screen. Even if the pivotable adjustment was not limited by the machine, the pivoting of the flood bar or squeegee is limited by the interference that would be created between the flood bar and squeegee, and each other, the edge of the screen (i.e., roller) and the print image.

Figure 2:
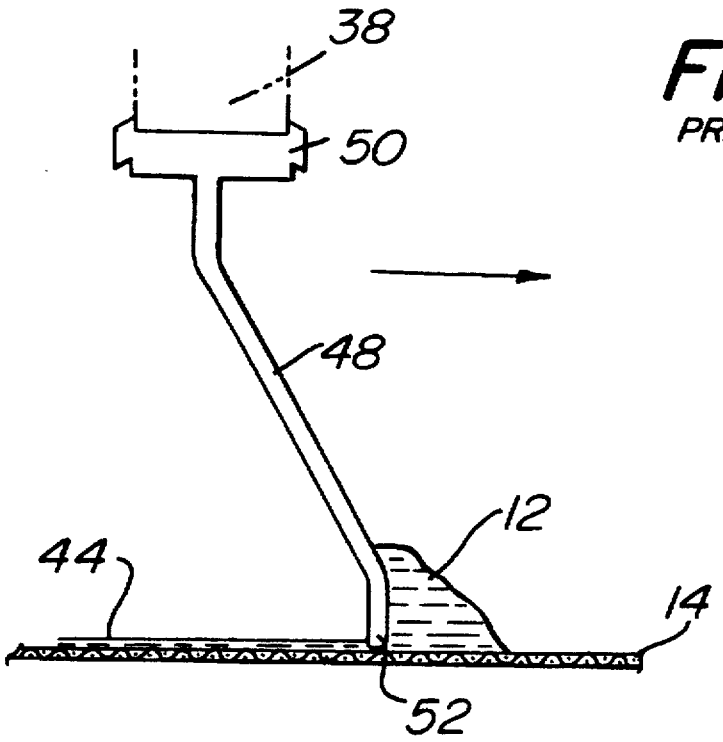
FIG. 2 PRIOR ART
FIG. 2 is a cross-sectional view of a screen fabric with a prior art flood bar.

FIG. 2 shows a prior art flood bar 48 over the screen fabric 14. The flood bar 48 has a mounting portion 50 at one end which is received by the mounting apparatus 38, partially shown in phantom. The other end of the flood bar 48 has a flooding portion 52. The flooding portion 52 of the flood bar 48 takes a quantity of the ink 12 and pushes it across the screen fabric 14 in an effort to achieve a generally uniform flood coat layer 44 over the top of the screen fabric 14.

Figure 3:
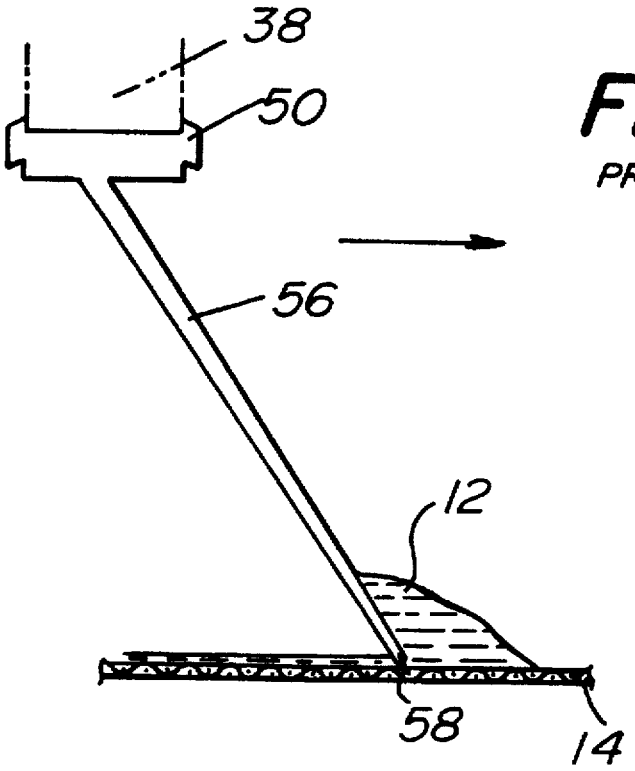
FIG. 3 PRIOR ART
FIG. 3 is a cross-sectional view of a screen fabric with a half tone prior art flood bar.

FIG. 3 shows a different style prior art flood bar 56, one which is used for half tone printing. Half tone printing is used for printing on substrates 32 with a series of dots, such as in four color processing. Four color processing most typically uses the four colors yellow, cyan, magenta, and black to create an image. The flood bar 56 has a flooding portion 58 that interacts with the screen fabric 14 at a diminished angle. The interaction of the flood bar at this diminished angle acts similar to a block planer scraping the ink as it moves across the screen fabric therein depositing a thinner layer of ink on the screen fabric 14 than that deposited by the flood bar 48. It is also recognized that, depending on the rate of speed at which the flood bar is moving and on the type of ink used, partial deposits in the orifices of the screen fabric could result.

Referring to FIG. 4, the squeegee 40 in the prior art first needs to push the ink 12 through the screen fabric 14. Then, in addition, the squeegee 40 pushes the screen fabric 14 into contact with the substrate 32. As can be seen in FIG. 4, a stencil 62 adhered to the screen fabric 14 defines the area where the ink 12 is placed. As the squeegee 40 moves over the screen fabric 14, deflecting the screen fabric, the screen fabric behind the squeegee 40 snaps upward away from the substrate 32, resulting in the deposition of the ink 12. FIG. 4 shows the screen fabric 14 exaggeratedly spaced from the substrate 32 in order to show the elements. A squeegee cannot successfully travel any faster than the time it takes the ink to first travel through the small orifices of the screen fabric, past the bottom of the stencil 62, to adhere to the substrate 32, and to pull/shear the ink 12 out of the orifices as the screen fabric snaps upward. If the squeegee travels too quickly, either no image or a partial image will result on the substrate 32.

The orifices 70 behind the squeegee 40, shown to the right in FIG. 4, are partially filled. Depending on the tension of the screen fabric 14, the type of ink 12 used, and the squeegee force and speed, the orifices could be either empty or only partially empty.

Examining the screen fabric 14 in more detail, the screen fabric 14 is comprised of a series of threads 64 running in two directions perpendicular to each other. The threads 64 form openings or orifices 70 in the screen fabric 14. In order to appreciate what the flood bar 10 has to accomplish in filling the orifices, the size of the orifices in a typical screen fabric 14 will be examined. In a 305 conventional mesh screen fabric having a thread diameter after weaving of approximately 47 microns at 0 Newtons/centimeter, there are 93,025 orifices in a square inch since there are 305 threads per inch. When the tension is increased to approximately 40 Newtons/centimeter, because of the screen fabric being elongated, there are approximately 78,400 orifices in a square inch. Converting microns to inches and multiplying by the number of threads in an inch (280 after tensioning) yields the area taken by fabric. The remaining area is open. Dividing the open area by the number of openings in a linear inch results in the size of the opening. Therefore, each of the orifices is approximately 0.00172 inches by 0.00172 inches in size.

The inks used for screen printing have varying material properties and viscosities and other theological characteristics. However, many inks typically have a consistency ranging from that of warm molasses to that of cream cheese. Therefore, the ink is not going to flow into the very small orifices very easily. The ink with the prior art flood bar will tend to stay on top of the screen and only partially fill the orifices.

With reference to the interaction with the screen fabric 14, the threads of the screen fabric in both directions act as a double cantilever wherein the deflection is related approximately to the cube of the distance from the roller (i.e., the end constraints). As the tension increases on the screen fabric 14 and the off contact distance can be reduced, the deflection resulting from a force is more uniform across the screen fabric; this is similar to increasing the stiffness of a beam.

Figure 5:
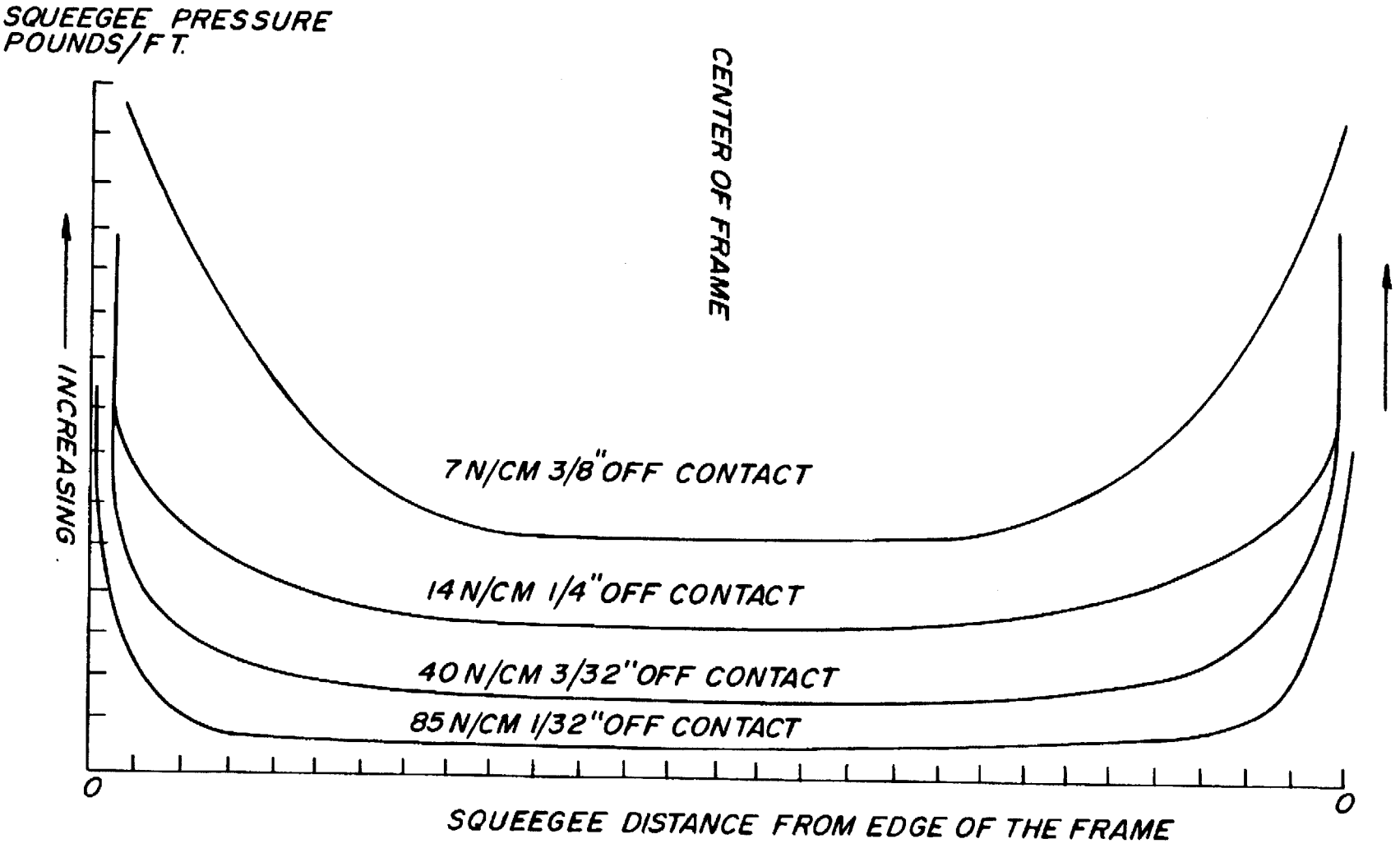
FIG. 5 is a prior art graph showing the off contact distance and the relationship between squeegee pressure pound per foot and the distance from the edge of the frame.

FIG. 5 shows a representation of the non-uniform pressure of the squeegee 40 needed to make contact with the printing substrate 32 below. This representation is prior art. As indicated above, as the tension of the screen fabric 14 increases, the distance between the screen fabric 14 and the substrate can be reduced since the curve tends to flatten out on the bottom portion indicating a more uniform interface pressure across the width of the screen. This is one of the reasons why a higher tension screen is preferred.

An additional benefit of increased tension in the screen fabric 14 is that it allows the flood bar 10, 48 to place a more uniform layer of ink 12 across the screen fabric, since the screen fabric does not deflect downward in the center as drastically as in a lower tension screen. The desire is usually to place the ink 12 uniformly in the orifices 70 of the screen fabric 14 with a fast stroke without having ink pre-expression. Ink pre-expression is the filling of the orifices 70 with ink to a point where the ink protrudes below the bottom of the screen as designated 72 in FIG. 4. Ink pre-expression results in the ink being compressed under the threads 64 and also the stencil 62 therein resulting in decreased quality (e.g., evidenced by an indistinct or hazy image). Ink preexpression is usually found in only low tension screen fabrics.

While the increase in tension of the screen fabric 14 has numerous benefits, it does not allow the flood bar 48 and 56 to move at a high enough rate of speed across the screen fabric 14 to achieve desired productivity. In the prior art, in order to get the ink 12 into the orifices 70, the flood bar 48 and 56 must be moved sufficiently slowly. Depending on the ink's viscosity and other rheological characteristics, moving the prior art flood bar 48 and 56 slowly still may result in only partially filling the orifices 70.

While the prior art arrangement may not deposit a sufficient amount of ink on the screen fabric because of scraping of the flood bar, one method of compensating for this problem involves raising the flood bar off the screen such that the ink is puddled above the screen fabric 14, and not in the orifices 70. While, depending on the characteristic of the ink 12, gravity might allow some of the ink 12 to settle into the orifices 70, the time between the flood bar 48 and 56 passing over the screen fabric 14 and the squeegee 40 passing over the fabric does not allow for gravity to have much of an effect. Typically, in an automatic printing machine 16, the squeegee 40 passes over a trailing edge 76 of the screen fabric 14 (i.e., the edge of the screen fabric 14 (opposite edge 78) towards which the flood bar moves and from which the squeegee 40 moves away in lowered operational position, as seen in FIG. 1) in fractions of seconds after the flood bar passes. In addition, because of the high viscosity, surface tension, and internal cohesion of some inks, and the size of the orifices, the effect of gravity will be virtually non-existent.

The second method of compensation involves having the squeegee 40 act both as a flood bar and a squeegee in the same pass. It is the inventor's opinion that, at the time of filing of this application, this is how most screen printers are currently functioning to speed the flooding and still print. This use of the squeegee as both the flood bar and the squeegee is different and distinct from using the squeegee as the flood bar whereby the squeegee passes once over the screen to flood it and a second time to act as a squeegee. In the method of the squeegee acting as both a flood bar and a squeegee in a single pass, the squeegee takes the ink that the flood bar has puddled or reservoired on top of the screen and first pushes it through the small orifices and then onto the substrate. In order for the ink to travel through the orifices and onto the substrate, the squeegee must slow down significantly and increase pressure. The resulting quality of the print of this method is not as desirable. The following is just an example of what might occur: dot and detail gain; heavier or lighter ink deposits than desired; ink film smoothness decreased; and increased passes of the squeegee required.

A third method involves pushing the flood bar into the screen with additional force. This technique pushes the ink through the screen in some spots therein giving ink pre-expression 72 in low tension screen fabrics, as seen in FIG. 4 and described above. With higher tension screen fabrics, the result will more likely be increased friction and scraping of the screen, thereby decreasing the life of the screen fabric and stencil. With the prior art described, the invention will be described and some of the benefits outlined.

Referring to FIG. 6, a flood bar 10 of this invention is shown in cross-sectional view overlying the screen fabric 14. The flood bar 10 has a mounting portion 82, a flooding portion 84, and an interposed connection portion 86. The mounting portion 82 of the flood bar 10 is similar to the mounting portion 50 of the prior art flood bar 48 and 56. The flooding portion 84 has a bottom surface 90 and a bulbous surface 92. The bottom surface 90 is substantially parallel to the top of the screen fabric 14. The bottom surface 90 has a width 93 greater than the width or thickness of the connection portion 86.

As the flooding portion 84 of the flood bar 10 moves across the screen fabric 14, the bottom surface 90 and bulbous surface 92 force the ink 12 into the orifices 70 of the screen fabric 14. The additional surface of the bottom surface 90 allows for a greater force pushing the ink 12 downward. Wherein the prior art flood bar 48 and 56 has a narrow bottom surface, if any, deflection occurs in the screen fabric 14, and the majority of the ink 12, therefore, remains above the orifices 70. The deflection of the screen fabric is more common in lower tension screens where the center of the screen sags ever so slightly, as evident in FIG. 5 and in the discussion above. In addition, if the flood bar 10 has any irregularities, such as nicks on the flooding portion 84, the increased area of the bottom surface 90 allows for a greater percentage of the ink 12 to get into the orifices 70 of the screen fabric 14. In contrast, with the narrow edge of the prior art flood bar 48, a single notch in the bottom surface would result in a line formed perpendicular to the direction of movement of the flood bar 48 wherein little or no ink is placed in the orifices of the screen fabric. In some situations, it could result in more ink deposited on the substrate than desired because the line of ink formed on the screen fabric 14 is pushed through the orifices 70 by the squeegee 40. The flood bar 10 has a leading or outer edge 94 of the flooding portion 84 which extends outwardly beyond the mounting portion.

The bulbous surface 92, an ink interaction surface, is ahead of or leads the bottom surface 90 as the flood bar 10 moves across the screen fabric 14 to the right, as seen in FIG. 6. The bulbous surface 92 places a downward force on the ink 12 to force the ink into the orifices 70 in screen fabric 14. In a preferred arrangement of this embodiment, the bottom surface 90 is 0.20 inches in width and the bulbous surface has a radius of 0.220 inches. The portion of the bulbous surface projecting downward forces the ink 12 into the orifices 70. This is in contrast to the prior art wherein the maximum thickness is 0.125 inches including the radiused edges.

Figure 7:
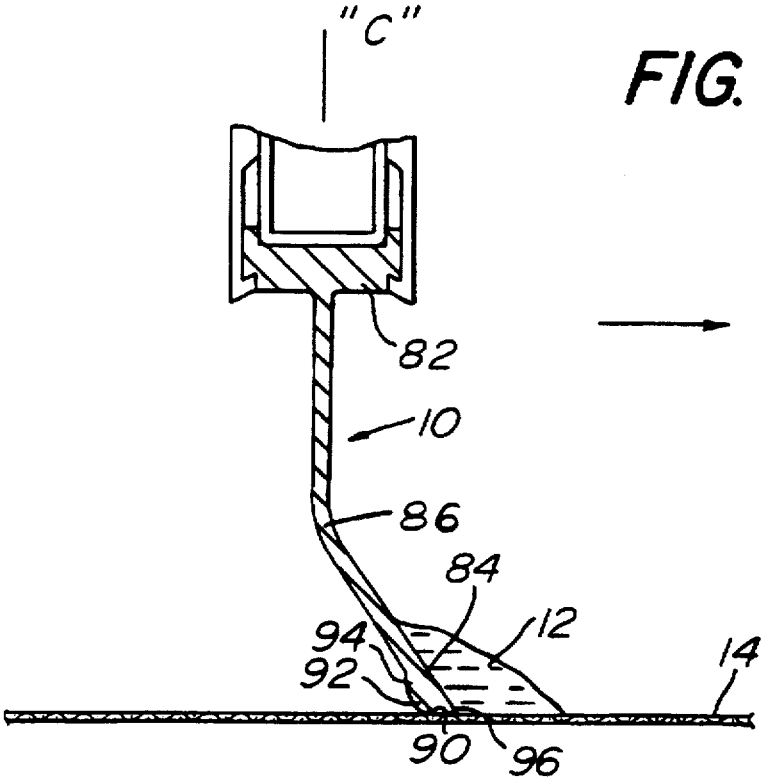
FIG. 7 is a cross-sectional view of the flood bar, the first embodiment acting as a flood bar in the other direction interacting with the screen fabric and ink.

FIG. 7 shows the same flood bar being used as a half tone flood bar. The flood bar is reversible such that it can be used both as a half tone flood bar and a rounded flood bar. If, during set-up, the operator determines that the desired result is not being achieved by the flood bar 10 in the position in which it is installed, the operator has the opportunity to reverse the flood bar on the mounting apparatus, thereby switching to the other style flood bar. Some of the benefits in this feature are that the operator would not have to leave the machine to get a different style flood bar 10 or have to clean an additional flood bar because several methods were tried. In this way, a heavier or lighter ink deposit can quickly be attained to accomplish the desired result.

Referring to FIG. 7, the flood bar 10 moves to the right and has a scraping edge 96 which leaves a thin layer of ink 12 on the screen fabric 14. The bottom surface 90 forces the ink 12 into the orifices 70. In a preferred arrangement of this embodiment, the scraping edge has a radius in the range of 0.05 to 0.015 inches. Therefore, in contrast to the prior art half tone flood bar 56, the flood bar 10 pushes the ink 12 into the orifices 70 instead of laying on top of the screen fabric 14. The bulbous surface 92 is trailing and therefore interaction with the ink 12 is minimal in this configuration. In addition, the bulbous surface is not likely to damage the screen fabric 14, since it has no sharp edges.

Still referring to FIG. 7, while the scraping edge 96 extends outwardly from the mounting portion, the outer edge of the flooding portion is in close proximity to a center line "C" of the flood bar 10. In a preferred arrangement of this embodiment, the scraping edge 96 extends from the center line "C" of the mounting portion 82 by 1.112 inches. Therefore, even with a reversal of the flood bar 10 from one style to the other, the flood bar 10 fits within the confines between the squeegee 40 and the edge of the screen defined by the roller 20, as seen in FIG. 1.

Figure 7A:
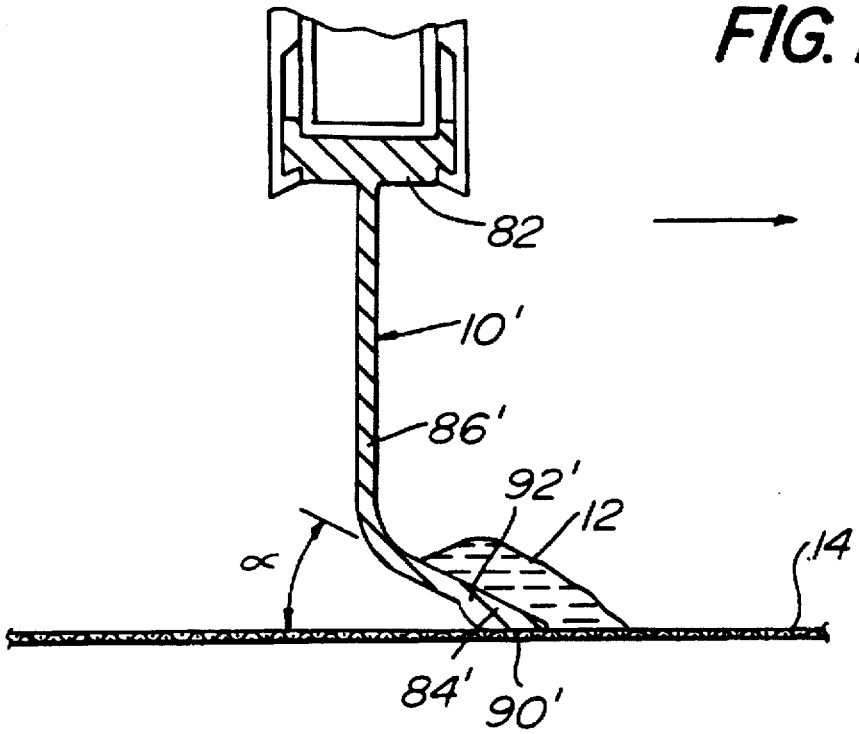
FIGS. 7A and 7B are alternative embodiments of the embodiment shown in FIG. 7.
Figure 7B:
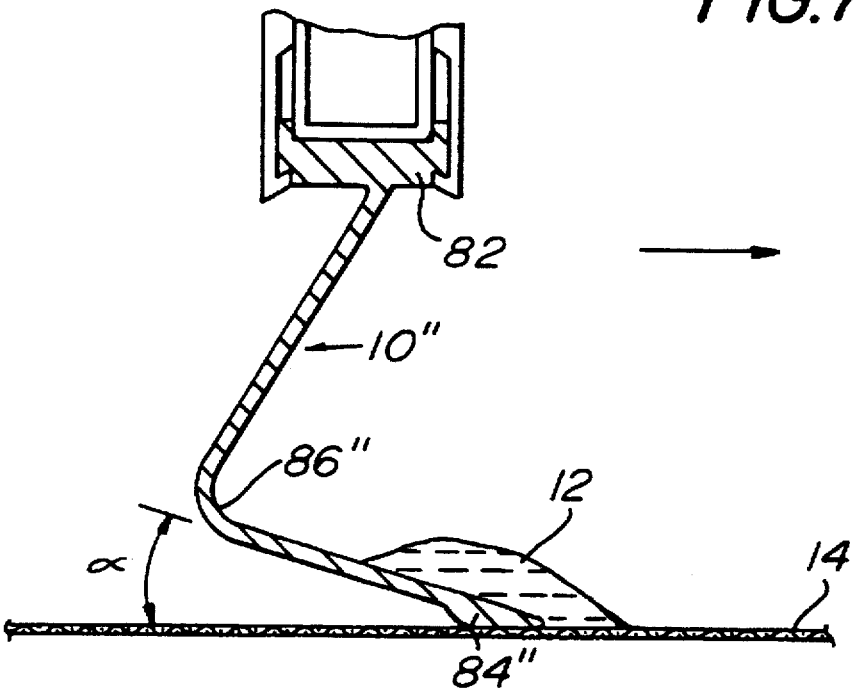

Referring to FIGS. 7A and 7B, two alternative flood bars 10' and 10" are shown. In FIG. 7A the connecting portion 86' extends downward in closer proximity to the screen fabric 14. The angle $\alpha$ between the flooding portion 84' and the screen fabric 14 is smaller. The bulbous surface 92' is flatter, thereby increasing the bottom surface 90'. In a preferred arrangement, the bottom surface is in a range of 0.225 inches to 0.300 inches. The bottom surface 90' is substantially parallel to the top of the screen fabric 14. In FIG. 7B, the connecting portion 86" projects in one direction, as contrasted to downward, and the flooding portion 84" is angled back in the other direction.

Figure 8:
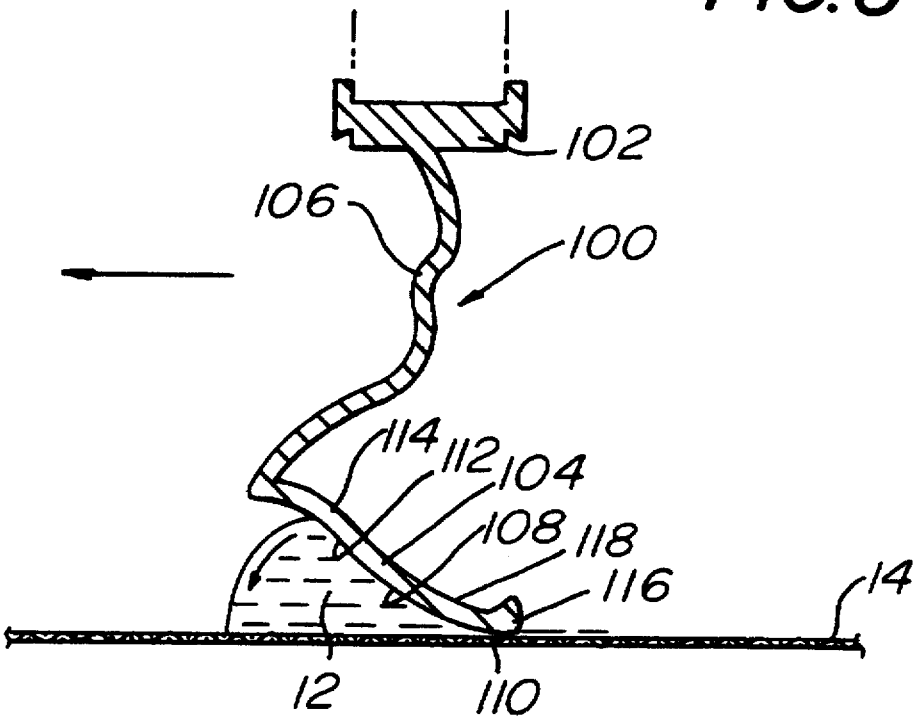
FIG. 8 is a cross-sectional view of a second embodiment of the flood bar interacting with the screen fabric and ink.

Referring to FIG. 8, a second embodiment of a flood bar 100, one of the preferred embodiments as of filing, is shown interactive with the screen fabric 14 and ink 12. The flood bar 100 is shown orientated for moving to the left as indicated by the arrow to flood in contrast to FIGS. 1–3, 6, and 7. The flood bar 100 has a mounting portion 102, a flooding portion 104, and an interposed connection portion 106. The mounting portion 102 of the flood bar is similar to that of the previous embodiment and the prior art. The flood portion 104 has a surface 108 consisting of a bottom surface 110 and an ink interaction surface 112. The ink interaction surface 112 is integral with the bottom surface 110 and flows in a smooth continuous transition therefrom and has both a concave and a convex portion. The ink interaction surface 112, while not in contact with the screen fabric 14, traps the ink 12 and, through the movement of the flood bar, pushes the ink downward into the orifices 70. The bottom surface 110, similar to the first embodiment, prevents the ink 12 from resting on top of the screen fabric 14.

Referring to FIG. 8A, an enlarged view of the flooding portion 104 of the flood bar 100 is shown interacting with the ink 12 and the screen fabric 14. The interaction of the flood bar 100, the ink 12, and the screen fabric 14 is a dynamic interaction and is difficult to observe without affecting the outcome. The improved results such as faster printing and reduced squeegee pressure achieved with the flood bar 100 of the invention are due to the ink 12 moving into the orifices 70 and not resting on top of the screen fabric 14. The movement of the flood bar 100 results in the ink 12 interacting with ink interaction surface 112 rotating the ink downward into the orifices 70. The rotation of the ink produces an injection speed downward and increases the hydraulic pressure.

FIG. 8A shows the ink 12 filling the orifices 70, in contrast to FIG. 4 which shows the ink 12 in front of the squeegee (i.e., this area was filled by the flood bar 48, not shown), still above the screen fabric 14 and just partially filling the orifices 70. The vector of the ink in the prior art flood bar is generally parallel to the screen fabric. In contrast, as indicated above, the revectoring of the ink downward in the invention increases the injection speed and the hydraulic pressure.

It has also been noted that the rotation of the ink 12 by the flood bar 100 drastically reduces the amount of ink 12 that moves perpendicular to the motion of the flood bar 100, therefore ink will not leak out on the edges of the flood bar.

Referring back to FIG. 8, the interposed connection portion 106 has a rib 114 for stiffening the flood bar 100. The flooding portion 104 of the flood bar 100 has a radius rear portion 116. In addition, the ink interaction surface 112 generally underlies the mounting portion 102, therefore minimizing the width of the flood bar 100 while still having a large ink interaction surface. The flood bar 100 can fit between the squeegee 40 and the roller 20. The bottom surface 110, in addition to forcing the ink 12 into the orifices 70, reduces wear on the screen fabric 14 since it moves parallel to the screen fabric.

In a preferred arrangement of this embodiment, the surface 108 is 1.8 inches wide with the highest point of the ink interaction surface 0.935 inches above the screen fabric 14 and the bottom surface 110. The bottom surface 110 is continuous with the lower portion ink interaction surface and formed at a radius of 1.620 inches, therein substantially flat at the bottom surface portion 110. The radius rear portion 116 angles back at 20° and has a radius of 0.060 from the bottom surface.

Figure 9:
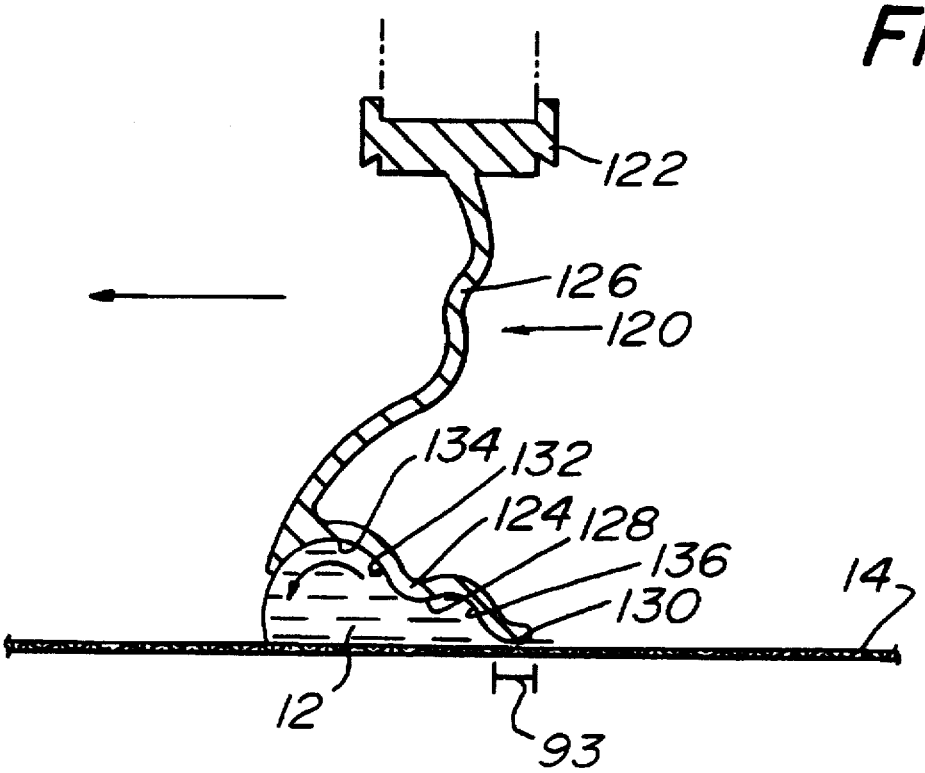
FIG. 9 is a cross-sectional view of a third embodiment of a flood bar interacting with a screen fabric and ink.

Referring to FIG. 9, a third embodiment of the flood bar 120 of this invention is shown in a cross-sectional view interacting with the screen and the ink. The flood bar 120 has a mounting portion 122 and an interposed connection portion 126 similar to the previous embodiment. The flood bar 120 has a flooding portion 124 having a surface 128. The surface 128 has a bottom surface 130 and an ink interaction surface 132 wherein the ink interaction surface 132 integrally flows from the bottom surface 130.

The ink interaction surface 132 is formed by concave curved portions 134 and 136. The first curved portion 134 has a larger radius than the second curved portion 136. Both curved portions 134 and 136 rotate the ink 12 in the counterclockwise direction as the flood bar 120 moves to the left as is shown in FIG. 9. The second curved portion 136 having a smaller radius has a larger angular velocity and normal acceleration. Both curved portions 134 and 136 create a downward component, as represented by the arrows, forcing the ink 12 into the orifices 70 of the screen fabric 14. The bottom surface 130 acts similar to those of previous embodiments.

As the flood bar 120 moves across the screen fabric 14, the amount of ink 12 in front of the flood bar 120 decreases as the ink 12 is deposited in the screen fabric 14. This results in the first curved portion 134 being devoid of ink. However, the second curved portion 136 continues to have ink to feed into the screen fabric 14.

In a preferred arrangement of this embodiment, the first curved portion 134 has a radius of 0.375 inches and the second curved portion 136 has a radius of 0.250 inches. A convex curved portion having a radius of 0.187 inches is interposed between the curved portions 134 and 136. The bottom surface 130 has a flat width 93 of 0.125 inches, a radius portion to the curved portion, and a curved trailing portion.

FIG. 10, a fourth embodiment of a flood bar 140 of the invention, another preferred embodiment as of filing, is shown in cross-sectional view interacting with the screen fabric 14 and the ink 12. The flood bar 140 has a mounting portion 142 and an innermost connection portion 146 similar to the previous embodiments. The flood bar 140 has a flooding portion 144 including a single curved portion 148. The curved portion 148 is formed from a single radius. The radius rotates the ink forcing the ink downward at a leading portion 152 of the curved portion. Similar to the previous embodiment, the flooding portion 144 has a bottom surface 150 for pushing the ink 12 into the screen fabric 14. The flooding portion 144 has a trailing edge 164 rounded upward from the substantially flat bottom surface 154 allowing for reversibility and reducing the chance of damage to the screen fabric 14.

In a preferred arrangement of this embodiment, the curved portion 148 has a radius of 0.25 inches about a point spaced 0.30 inches from the bottom surface. The bottom surface 150 has a flat surface with a width of 0.125 inches, a radius leading edge portion 156, and a trailing edge portion 154. The leading edge 156 has a radius of 0.156 inches and blends into the curved portion 148. The trailing portion 154 has a radius of 0.93 inches.

Referring to FIG. 11, a fifth embodiment of a flood bar 160 of this invention is shown in cross-sectional view interacting with the screen fabric 14 and the ink 12. The flood bar 160 has a mounting portion 162 and an interposed connecting portion 166 similar to the other embodiments. Like the fourth embodiment, the flood bar 160 has a flooding portion 164 having a single curved portion 168. However, in contrast to the fourth embodiment, the single curved portion 168 is formed from a series of radii 172 and 174 such that the rear portion has a more vertical component. The curved portion 168 rotates the ink 12, forcing the ink downward at a leading portion 176 of the curved portion 168. In contrast to the previous embodiments, the flooding portion 164 does not have a bottom surface 170 that is wider than that of the prior art. Instead, the curved portion 168 places all of the ink 12 into the screen that is desired. The flooding portion has a sharp trailing portion 178 to scrape the ink 12 off the upper layer of the screen fabric 14. This flood bar 160 is contemplated by the inventor to be used predominately with screen fabrics used for half tone printing or other thin deposit applications such as U.V. clear coats.

Figure 12:
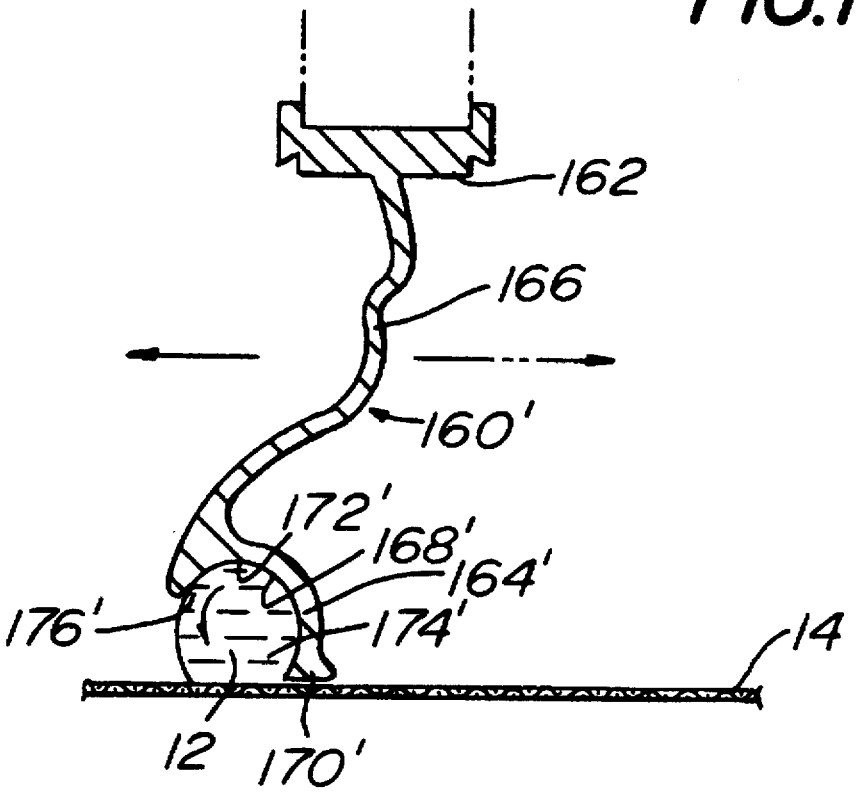
FIG. 12 is a cross-sectional view of an alternative embodiment of the fifth embodiment of a flood bar interacting with the screen fabric and ink.

FIG. 12 shows an alternative embodiment to the fifth embodiment flood bar 160' and is a third preferred embodiment as of filing. The flood bar 160' has a single curved portion 168' having a series of radii 172' and 174' such that the rear portion has a more vertical component. The curved portion 168' rotates the ink 12 forcing the ink 12 downward at a leading portion 176' of the curved portion 168'. However, in contrast to the fifth embodiment shown in FIG. 11, the flooding portion 164' has a bottom surface 170' that is wider than the prior art and creates more opportunity to push the ink 12 into the orifices 70 of the screen fabric 14. This flood bar 160' is contemplated to be reversible similar to the flood bar 10 shown in FIGS. 6 and 7.

Referring to FIG. 13, a sixth embodiment of a flood bar 180 of this invention is shown in side view. The flood bar, like that of the second embodiment shown in FIG. 9, has a flooding portion 184 having a surface 188 consisting of a bottom surface 190 and an ink interaction surface 192. The surface 188 shown in FIG. 13 is identical to that shown in FIG. 8. In addition, the flooding portion 184 has an additional bar 194 projecting upward to the connecting portion 186. This flood bar is contemplated to be able to be used in two directions similar to the flood bar 10 of FIGS. 6 and 7. It is contemplated that an end cap could be fitted to the space defined by the flooding portion 184, the connecting portion 186, and the bar 194. The cap would ensure that the interior was kept clean of ink. The cap would also increase the rigidity of the flood bar 180 and therefore allow the flood bar 180 to be made lighter and thinner.

Figure 14:
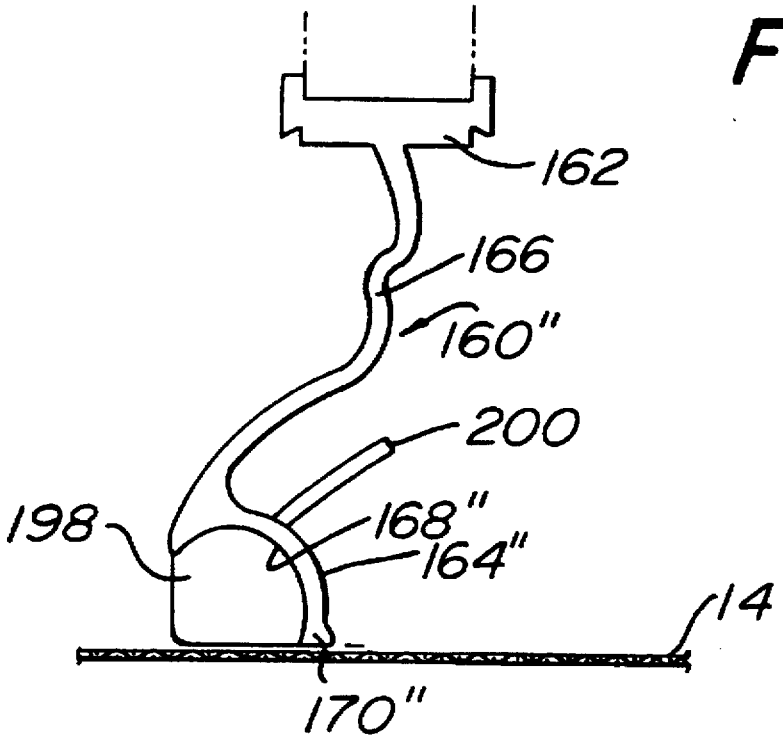
FIG. 14 is a side view of the fifth embodiment of the flood bar having end caps.

FIG. 14 shows a second alternative embodiment to the fifth embodiment flood bar 160". Like the embodiment shown in FIG. 12, the flooding portion 164" has a bottom surface 170" that is wider than the prior art. The flood bar 160" has an end cap 198 which fits in the single curved portion 168". The end cap 198, in addition to the rotation of the ink, ensures that none of the ink 12 moves perpendicular to the direction of the movement of the flood bar 160" and out the sides. In addition, the flood bar 160" has a tube 200 through which the ink 12 is fed to the flood bar 160" from an ink supply. Therefore, the operator does not have to take the time to resupply ink 12.

The present invention may be embodied in other specific forms without departing from the spirit or essential attributes thereof, and, accordingly, reference should be made to the appended claims, rather than to the foregoing specification, as indicating the scope of the invention. It is recognized that the dimension of the flood bar can be tailored depending on, among other things, the ink used and the substrate to be printed on. For example, for printing on bill boards, the dimension of the ink interaction surface would be increased and the height of the leading portion that is above the screen would be increased to increase the reservoir. Substrates that are screen printed include automotive parts, bottles, fabrics, gaskets, and glass.

It should be recognized that, while the objective is to place more ink in the orifices, there may be situations where it is desired to raise the flood bar a distance above the screen to only partially fill the orifices.

I claim:

1. An apparatus located in proximity to a planar screen fabric for placing ink into orifices of the screen fabric for printing comprising:

a mounting portion for receiving translational motion generally parallel to the screen fabric;

a flooding portion having a bottom surface generally parallel to the screen fabric, the bottom surface having a width greater than 0.125 inches, the flooding portion also having a bulbous surface for interacting with the ink and placing the ink into the orifices of the screen fabric.

2. An apparatus for placing ink into orifices of a screen fabric as in claim 1, wherein the flooding portion includes a curved ink interaction surface spaced and overlying the screen fabric, the ink interaction surface adapted for interacting with the ink to rotate the ink forcing the ink into the orifices of the screen fabric.

3. An apparatus for placing ink into orifices of a screen fabric as in claim 2, further comprising at least one tube for supplying the ink to the ink interaction surface.

4. An apparatus for placing ink into orifices of a screen fabric as in claim 3, wherein the curved surface of the ink interaction surface is a concave curved portion adapted for rotating the ink, the concave curved portion opening towards the screen fabric.

5. An apparatus for placing ink into orifices of a screen fabric as in claim 1, wherein the bottom surface has at least one edge having a radius of curvature.

6. An apparatus for placing ink into orifices of a screen fabric as in claim 5, wherein the bottom surface has a width greater than 0.140 inches.

7. An apparatus for placing ink into orifices of a screen fabric as in claim 5, wherein the bottom surface has a width in the range of 0.20 inches to 0.40 inches.

8. An apparatus for placing ink into orifices of a screen fabric comprising:

a mounting portion for receiving translational motion generally parallel to the screen fabric;

a flooding portion having a bottom surface generally parallel to the screen fabric, the bottom surface having a width greater than 0.125 inches, the flooding portion also having an ink interaction surface having at least one concave curved portion adapted for rotating the ink, the concave curved portion opening towards the screen fabric.

9. An apparatus for placing ink into orifices of a screen fabric as in claim 8, wherein the at least one concave curved portion has a radius in the range of 0.20 inches to 0.40 inches.

10. An apparatus for placing ink into orifices of a screen fabric as in claim 8, wherein a center of curvature of the concave portion is located less than twice the radius of curvature from the bottom surface.

11. An apparatus for placing ink into orifices of a screen fabric as in claim 8 further comprising at least one tube for supplying the ink to the ink interaction surface.

12. An apparatus for spreading and positioning ink in orifices of a screen fabric for printing, comprising:

a mounting portion adapted for receiving translational motion;

a flooding portion having an ink interaction surface spaced and adapted for overlying the screen fabric, the ink interaction surface adapted for interacting with the ink to force the ink into the orifices of the screen fabric, the ink interaction surface having a pair of concave curved portions, one of the concave curved portions having a larger radius than the other concave curved portion.

13. An apparatus for spreading and positioning ink in orifices of a screen fabric as in claim 12, wherein the flooding portion further comprises a bottom surface adapted to be generally parallel to the screen fabric and having at least one edge having a radius of curvature, the bottom surface having a width greater than 0.125 inches for forcing the ink into the screen fabric.

14. An apparatus for spreading and positioning ink in orifices of a screen fabric as in claim 13 wherein the smaller radius concave curved portion is interposed between the larger radius concave portion and the bottom surface.

15. An apparatus for spreading and positioning ink in orifices of a screen fabric as in claim 12, further comprising at least one tube for supplying the ink to the ink interaction surface.

16. An apparatus for spreading and positioning ink in orifices of a screen fabric comprising:

a mounting portion adapted for receiving translational motion;

a flooding portion having an ink interaction surface spaced and adapted for overlying the screen fabric, the ink interaction surface adapted for interacting with the ink to force the ink into the orifices of the screen fabric; and the flooding portion including a bottom surface having a width of at least 0.125 inches and a pair of edges which are configured differently, the flooding portion being reversible for placing different quantities of ink on the screen fabric by moving the apparatus in either direction.

17. An apparatus for spreading and positioning ink in orifices of a screen fabric as in claim 16, further comprising at least one tube for supplying the ink to the ink interaction surface.

18. A screen printing machine, comprising:

a tensioning frame having a screen fabric, the tensioning frame carried by the screen printing machine;

a platform adapted for holding a substrate, the platform held in spaced relationship from the tensioning frame, generally parallel to the screen fabric;

a head slideably carried for translational movement in a plane parallel to the screen fabric, the head positioned such that the screen fabric is interposed between the platform and the head, the head having a pair of mounting apparatus;

a flood bar and a squeegee carried by the mounting apparatus of the head; and the flood bar having a mounting portion adapted for receiving translational motion and a flooding portion including an ink interaction surface spaced and overlying the screen fabric, the ink interaction surface adapted for interacting with ink to force the ink into the screen fabric without deformation of the screen fabric into contact with the substrate, the ink interaction surface having at least one concave curved portion adapted for rotating the ink.

19. A screen printing machine as in claim 18, wherein the at least one concave curved portion has a radius in the range of 0.20 inches to 0.40 inches.

20. A screen printing machine as in claim 18, further comprising at least one tube for supplying the ink to the ink interaction surface.

21. A screen printing machine comprising:

a tensioning frame having a screen fabric, the tensioning frame carried by the screen printing machine;

a platform adapted for holding a substrate, the platform held in spaced relationship from the tensioning frame, generally parallel to the screen fabric;

a head slideably carried for translational movement in a plane parallel to the screen fabric, the head positioned such that the screen fabric is interposed between the platform and the head, the head having a pair of mounting apparatus;

a flood bar and a squeegee carried by the mounting apparatus of the head; and the flood bar having a mounting portion adapted for receiving translational motion and a flooding portion having an ink interaction surface spaced and overlying the screen fabric, the ink interaction surface adapted for interacting with ink to force the ink into the screen fabric without deformation of the screen fabric into contact with the substrate, the flooding portion also having a bottom surface generally parallel to the screen fabric, the bottom surface having a width greater than 0.125 inches for forcing the ink into the screen fabric.

22. A screen printing machine as in claim 21 wherein the bottom surface has at least one edge having a radius of curvature.

23. A screen priming machine as in claim 22 wherein the bottom surface of the flooding portion has a width in the range of 0.20 inches to 0.40 inches.

24. A screen printing machine as in claim 22 wherein the bottom surface of the flooding portion has a width greater than 0.140 inches.

25. A screen printing machine as in claim 21, wherein the ink interaction surface of the flooding portion is a bulbous surface.

26. A screen printing machine as in claim 21, wherein the ink interaction surface has at least one concave curved portion adapted for rotating the ink, the concave curved portion opening towards the screen fabric.

27. A screen printing machine as in claim 21, wherein the ink interaction surface has at least one concave portion adapted for rotating the ink, the center of curvature of the concave portion being located less than twice the radius of curvature from the bottom surface.

28. A screen printing machine as in claim 21, further comprising at least one tube for supplying the ink to the ink interaction surface.

29. A screen printing machine comprising:

a tensioning frame having a screen fabric, the tensioning frame carried by the screen printing machine;

a platform adapted for holding a substrate, the platform held in spaced relationship from the tensioning frame, generally parallel to the screen fabric;

a head slideably carried for translational movement in a plane parallel to the screen fabric, the head positioned such that the screen fabric is interposed between the platform and the head, the head having a pair of mounting apparatus;

a flood bar and a squeegee carried by the mounting apparatus of the head; and the flood bar having a mounting portion adapted for receiving translational motion and a flooding portion having an ink interaction surface spaced and overlying the screen fabric, the ink interaction surface adapted for interacting with ink to force the ink into the screen fabric, the ink interaction surface of the flooding portion having a pair of concave curved portions, one of the concave curved portions having a larger radius than the other concave curved portion.

30. A screen printing machine as in claim 29, wherein the flooding portion further comprises a bottom surface generally parallel to the screen fabric, the bottom surface having a width greater than 0.125 inches for forcing the ink into orifices of the screen fabric.

31. A screen printing machine as in claim 30 wherein the smaller radius concave curved portion is interposed between the larger radius concave curved portion and the bottom surface.

32. A screen printing machine as in claim 29, further comprising at least one tube for supplying the ink to the ink interaction surface.

33. A method of spreading and positioning ink in orifices of a screen fabric comprising the steps of:

providing a flood bar in proximity to the screen fabric;

moving the flood bar translationally generally parallel to the screen fabric without deformation of the screen fabric into the substrate;

rotating the ink with a curved ink interaction surface of the flooding portion of the apparatus to force the ink downward into the orifices of the screen fabric; and pushing the ink with a bottom surface of the flood bar which is generally parallel to the screen fabric to assist in placing the ink into the orifices.

* * * * *